US006124807A

United States Patent [19]

Heckeroth et al.

[11] Patent Number: 6,124,807

[45] Date of Patent: Sep. 26, 2000

[54] PROCESS AND APPARATUS FOR REGULATING TRAFFIC

[75] Inventors: Rüdiger Heckeroth, Bad Wildungen; Bernd Petzold, Müncheberg, both of Germany

[73] Assignee: Albert E. Voehringer, Wayne, Pa.

[21] Appl. No.: 08/150,053

[22] PCT Filed: Apr. 2, 1993

[86] PCT No.: PCT/EP93/00815

§ 371 Date: Nov. 18, 1993

§ 102(e) Date: Nov. 18, 1993

[87] PCT Pub. No.: WO93/20545

PCT Pub. Date: Oct. 14, 1993

[30] Foreign Application Priority Data

Apr. 2, 1992 [EP] European Pat. Off. ..... 92105771

[51] Int. Cl.[7] ..... G08G 1/095

[52] U.S. Cl. ..... 340/908; 340/923; 340/933; 701/117

[58] Field of Search ..... 340/907, 908, 340/908.1, 920–923, 915, 911, 933; 701/117

[56] References Cited

U.S. PATENT DOCUMENTS

| | | | |
|---|---|---|---|
| 2,933,716 | 4/1960 | Soderberg | 340/920 |
| 3,529,286 | 9/1970 | Wapner | 340/921 |
| 3,833,881 | 9/1974 | Debinger et al. | 340/920 |
| 4,390,951 | 6/1983 | Marcy | 364/436 |
| 5,252,969 | 10/1993 | Kishi | 340/908 |

FOREIGN PATENT DOCUMENTS

| | | |
|---|---|---|
| 2359451 | 2/1978 | France . |
| 1813336 | 10/1970 | Germany . |

*Primary Examiner*—Daniel J. Wu
*Attorney, Agent, or Firm*—Venable; Robert Kinberg; Catherine M. Voorhees

[57] ABSTRACT

Process for regulating traffic by means of moveable light signalling equipment (mobile traffic lights; A, B), particularly at restricted areas (E), using sensor controls which prescribe go times (green phases, $T_F$) and clearance times (red phases $T_R$) in the area to be secured, i.e. along a blocked stretch (S), wherein the transit time ($T_D$) of vehicles (F) over a measured distance (M) extending substantially along the blocked stretch (S) is measured and the clearance time ($T_R$) is established as a function of the transit time measurements ($T_D$) obtained.

17 Claims, 5 Drawing Sheets

PROCESS AND APPARATUS FOR REGULATING TRAFFIC

This application is a 371 of PCT/EP93/00815 filed on Apr. 2, 1993.

BACKGROUND OF THE INVENTION

1. Field of the Invention

The invention relates to a process and an apparatus for regulating traffic.

2. Background Information

Portable light signal equipment is already known which is used for regulating traffic at restricted points or as a replacement for defective stationary equipment. Frequently, it is observed that moveable traffic lights of this kind—which are required at building sites, for example—are frequently not optimally adapted to the traffic flow, for reasons of time, and as a result cause unnecessary delays to much of the traffic, particularly when the traffic flow is fluctuating.

Of the conventional portable light signalling equipment there is equipment without any feedback system which operates with extremely accurate quartz oscillators as the time base. The stop, go and clearance times are strictly programmed and are usually only very broadly adapted to the actual traffic and are invariable in their daily operation.

Centrally controlled and monitored equipment with passive light signalling equipment allows the signal to be set by feedback. However, they do require expensive cables the size of which has to be adapted to the power to be transmitted (including the current supply to the lights).

From DE-A-1813336 an apparatus for controlling two traffic lights is known, in which axle counters are provided which will switch the apparatus over by means of counters whenever there is a coincidence between two counting circuits, i.e. when the number of the counted vehicles leaving the restricted area has reached the number of the vehicles which entered this area. However, there is the problem that these numbers are different if vehicles remain in the restricted area or enter the restricted area from this point. In this case, the equipment has to be switched off. Moreover, this equipment does not provide separate go and clearance times.

In a process for adapting the function of traffic lights to the traffic flow, as known from FR-A-2359451, the green phases of a traffic light apparatus are adapted to the number of vehicles passing, the phases being extended as the number of vehicles passing the equipment during one phase increases. However, once again, no distinction is made between go and clearance times.

SUMMARY OF THE INVENTION

The invention has the objective of making it possible to regulate the traffic throughput, particularly at restricted points, even better, using a process of the kind described hereinbefore. In particular, it sets out to provide optimum clearance times which should be achieved in a short time. The light signalling equipment should if possible be easy and safe to operate even by untrained personnel.

The invention includes the finding that, with a process of this kind, the clearance time has to be determined separately from the duration of the go times since the clearance time, unlike the go times, is not directly dependent on the amount of traffic but primarily on the geometric length of the restricted area through which the traffic has to pass and the driving speed of the drivers involved. By contrast, larger amounts of traffic may even involve shorter clearance times. (The "clearance time" is the period after the end of a green phase which the vehicles within the restricted area will take to leave this area.) According to the invention, the clearance time actually required is determined from the time shift between the progress of the sensor signals at the entry and exit points or the signal patterns derived therefrom. The restricted area is detected as a dead time component affected by disruptions, the sensor signal at entry being the undelayed signal and the sensor signal at exit being the delayed signal. The desired clearance time is derived from the delay time of the dead time component thus determined, corresponding to the transit time.

Preferably, the transit time of vehicles is measured over a measured distance along the blocked-off stretch and the clearance time is controlled as a function of the transit time measurements stored in the memory and optimised stepwise by repeated re-adjustment.

Precise adjustment of the clearance time is of particular importance when protecting restricted areas which are several hundred meters long, as frequently occurs. If, in an extreme case, green is already showing while traffic is still flowing in the opposite direction because it was obstructed, for example, by construction vehicles standing in the way, the protection system for the restricted area may become entirely out of sequence.

The transit time is preferably measured by detecting the vehicles transversely and/or diagonally to the direction of travel at both ends of the measured distance, i.e. at the entry and exit points of the area to be secured. Sensors are provided there, preferably a sensor on each associated traffic light. A two-beam scanning arrangement, in particular, is possible, in which one sensor is directed diagonally backwards and the other at right angles to the direction of travel, in order to detect not only the vehicles travelling through but also to determine their speed at that moment. The traffic lights belonging to the system each have their own control unit and are connected to one another by an information transmitter, optionally together with a central control unit.

The use of active traffic lights of this kind makes it possible to transmit only the control and feedback signals through multi-core signal leads or over multi-channel radio, if these are used.

Because of the use of data processing technology both in the central control unit and in the decentralized control and monitoring units, it is advisable to use a two-wire signal bus (NATO telephone line) which requires the least expenditure on cables.

For detecting the traffic flow, passive infrared movement transmitters are preferably used, in the event of a mobile traffic light construction, these infrared movement detectors being directed towards the oncoming traffic. If there is no time gap between successive vehicles to signal a break in the traffic flow, by exceeding a preset time, the go time (green phase) is increased to a preset maximum. If desired, with the process according to the invention, the equipment can be switched to so-called demand operation—without restricting its efficiency—if there is light traffic, so that go signals can be transmitted to traffic approaching from other directions as necessary, an arrangement which is highly favorable for preventing noise in residential areas with single vehicles travelling at night.

The invention brings about a substantial increase in traffic safety, in that the operation can be reduced to switching on the equipment, which makes it particularly advantageous for use on building sites. In particular, there is no need to adapt the parameters of the equipment to the geometry of the restricted area. In fact, by starting from a maximum clearance time the apparatus will regulate itself to the actual amount of traffic within a few measuring periods. Moreover, a continuous flow of traffic is achieved by the fact that, in the event of momentary obstructions within the restricted area, the green light opposite is delayed until after the vehicles have been cleared. This prevents drivers from entering from both ends and thereby avoids additional traffic congestion. In addition, drivers will not enter the restricted area on red, or even wait till red before entering, on the assumption that the equipment is defective. Since the clearance speed varies in the course of the day, there are sharp fluctuations in the clearance time actually needed, and for the first time this will be used according to the invention as a variable to optimise the traffic flow.

The new process makes it possible to recognise extreme variations in volume of traffic at the approaches, particularly in its preferred embodiments, so that an approach having a low volume of traffic will be given just enough stop time to allow vehicles to collect and travel through in one block when the go signal is given. If the transit time is more than 300 seconds for several cycles, the operating staff can be required to take special measures in order to clear the congestion, e.g. to operate the system manually with a variable clearance time, to allow a higher clearance speed and indicate it. If a system is operated in quasi-stationary manner for a length of time, the learning capacity of the system proves particularly favorable for reacting to daily or weekly changes in the rhythm of the traffic parameters with a corresponding delay. Even if the driving distance and speed alter considerably as a result of contamination on the road or other temporary obstructions, the preset time gap, which will then not be constant either, will adapt to the circumstances for the traffic flow by means of the process according to the invention.

If according to another advantageous feature of the invention the transit time determined is an average time taken by at least a selected number of vehicles, the measurement cannot be falsified by individual vehicles the transit time of which differs from that of the entire column of traffic but might happen to be picked up by the measuring sensors.

Preferably, the transit time is determined from the difference between the average times taken to pass the entry and exit of the restricted area by at least a number of vehicles, but preferably the entire column of vehicles.

In order to take account of the presence of gradients and the like, it is advantageous according to another preferred embodiment of the invention if the transit time is detected separately depending on the direction of travel.

BRIEF DESCRIPTION OF THE DRAWINGS

Other advantageous features of the invention are described hereinafter together with the description of the preferred embodiment of the invention with reference to the drawings. In the drawings.

DETAILED DESCRIPTION OF THE PREFERRED EMBODIMENT(S)

Figure 1:
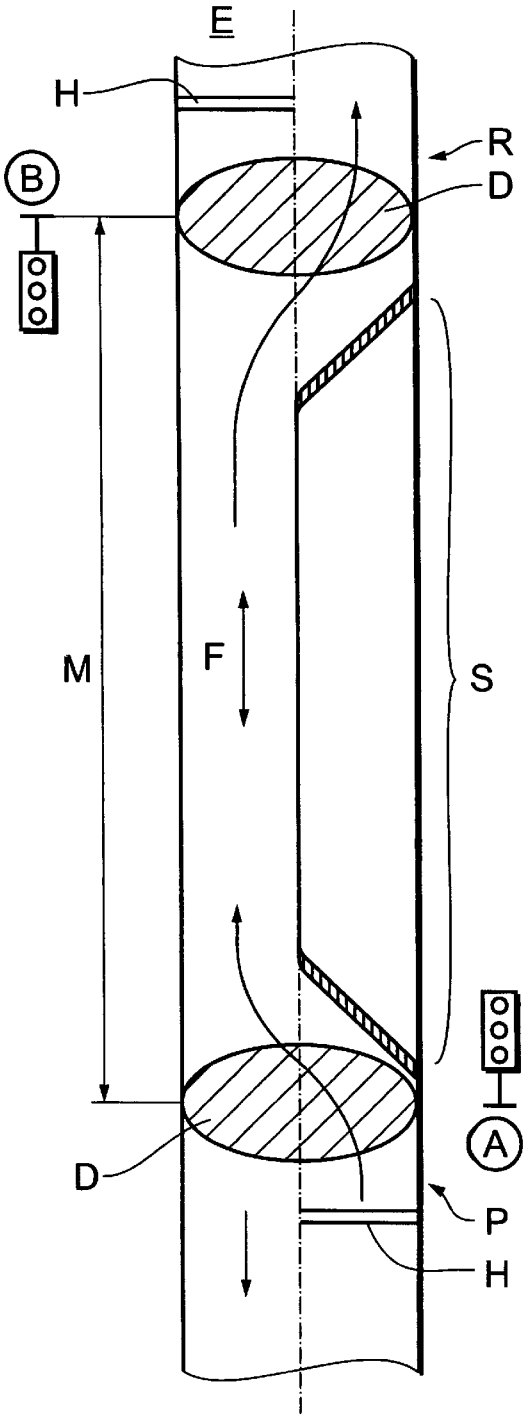
FIG. 1 is a diagrammatic plan view of a restricted area with a two-station light signalling apparatus.

An exemplary embodiment of an apparatus operating by the process according to the invention consists of two light signals (traffic light stations A, B) with conventional signal transmitters 10 at each end P, R of a measured distance M in a restricted area E (FIG. 1) through which a volume of traffic F is to be guided in only one direction during a length of time determined, for example, by construction activities.

Figure 3:
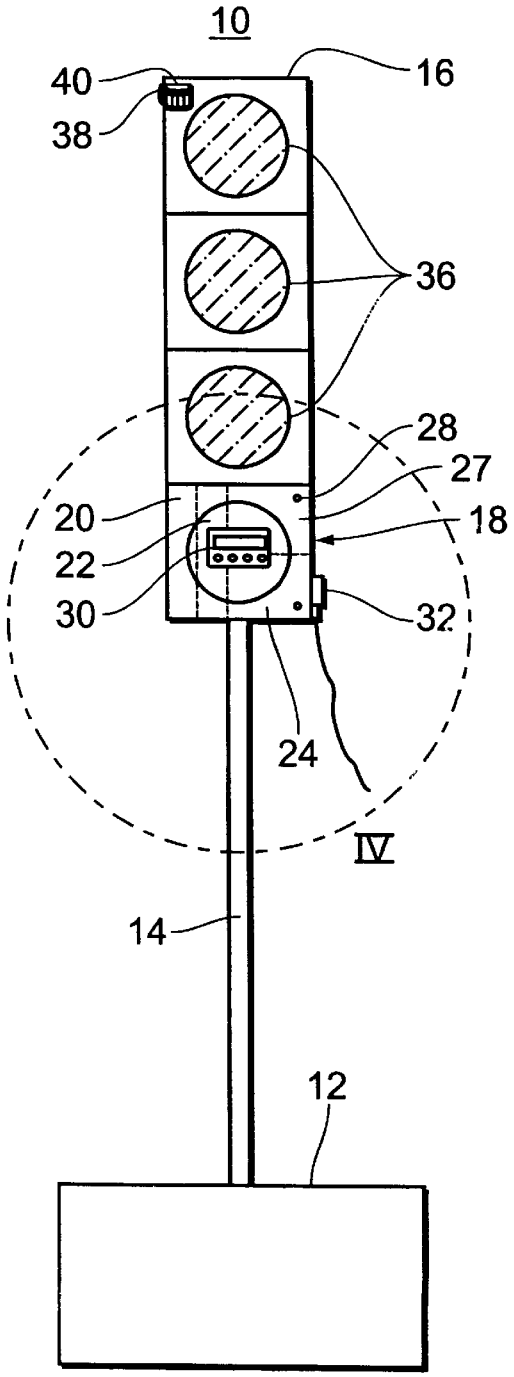
FIG. 3 is a front elevation of a traffic light.
Figure 2:
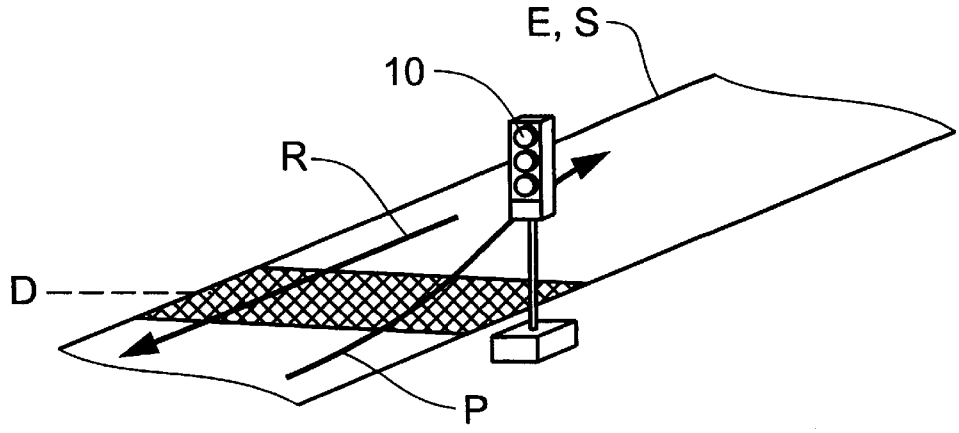
FIG. 2 is a diagrammatic diagonal view to illustrate a light signalling station at the end of a restricted area.

For this purpose, at least one sensor (movement indicator 38) is mounted on each light signal transmitter 10 in such a way that it acts as a detector of individual vehicles along a measured distance M in a zone D which runs substantially at right angles to the direction of travel (cf FIGS. 1 and 2) and is located between stopping points indicated by bars H and the beginning and end of a measured distance S. These sensors are provided at each entry and exit point P or R of the area E to be protected in such a way that they detect all the vehicles entering or leaving this area. Preferably, one sensor is sufficient for this, secured directly to the light signal transmitter 10 and aligned accordingly (FIG. 3). The same sensor can also be used at the same time to carry out the time gap procedure for controlling the go time. All the light signal transmitters 10 belonging to the apparatus have their own control unit 20 but are also subject to central control and connected to one another or to the central control unit by means of a data transmitter 24 (FIG. 5) via a cable or radio connection.

Figure 4:
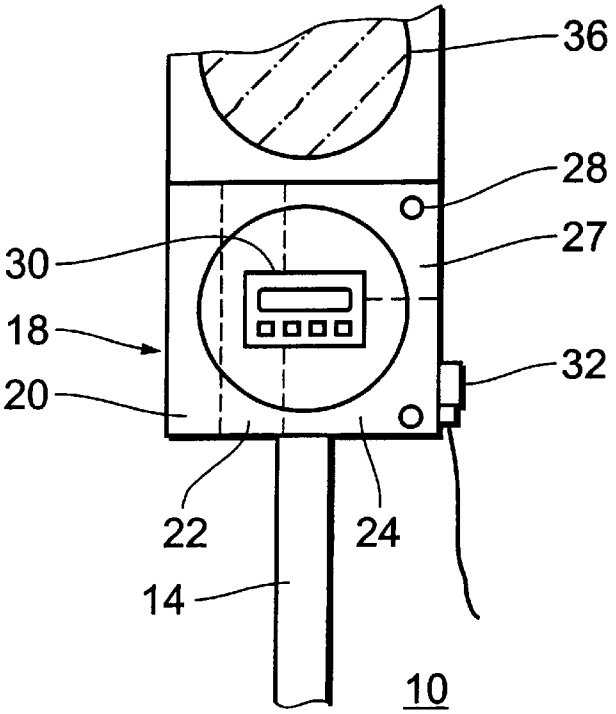
FIG. 4 is an enlarged detail from FIG. 3 corresponding to the circle IV therein.

As can be seen from FIGS. 3 and 4, in particular, each light signal transmitter 10 has an anti-dazzle light unit 16 equipped with signal lamps and below this, in a chamber 18, a control unit 20 for determining the actual traffic signal to be transmitted and for keeping to the required signal times, as well as a correlator or comparator 22, a data transmitter 24 and a safety device 27 for monitoring the signal progress and for issuing fault signals in the event of breakdown. The current supply is provided by means of a mains connection or from a battery box 12, which may also form the base of the light signal transmitter 10. This latter may also have connections 32 for connecting cables for data transmission or for a manual operation unit (not shown).

Associated with the control unit 20 are operating elements 28, 30 which are either fixedly mounted or which can be put on and taken off, for adjusting intermediate periods such as the red-amber period or amber period and for setting the preset and threshold values for the green and clearance times TF and TR, respectively, in the individual traffic phases. In simplified equipment the range of use of which permits fixed values, these operating elements can be omitted.

Each sensor or detector (movement indicator 38) detects only the moving traffic flow F in both directions, at right angles to the traffic in zones D in the end regions of the restricted area E. However, these detectors do not indicate vehicles coming up to the traffic lights A, B or waiting at them. This can be done by any sufficiently selective movement indicator which also provides the necessary resolution, e.g. pressure hoses, infrared, ultrasonic and radar sensors and induction loops, light beams and so on. The apparatus according to the invention operates all the better, the more accurate the detection of the traffic flow F.

At the start of the apparatus the or each control unit 20 first uses selected or prescribed pre-set clearance times Ti. In the simplest case, a rotary regulating unit (e.g. designated 28) can be used to set the length of the measured distance (in meters)—substantially corresponding to the distance between the traffic lights A, B—from which the control unit 20 determines a clearance time $T_R$ corresponding to safety guidelines.

The process for automatically setting the clearance time will now be described more fully with reference to the block diagram in FIG. 5: immediately after the setting up and switching on of the equipment it operates with preset clearance times Ti given by corresponding operating elements 28 or preferably fixedly provided in a presetting stage. As soon as the control unit 20 has caused the go signal to be emitted for the first time via the light signal transmitter 10, the sensor at the entry end detects those vehicles F which are passing the entry point P into the area to be secured.

Figure 6A:
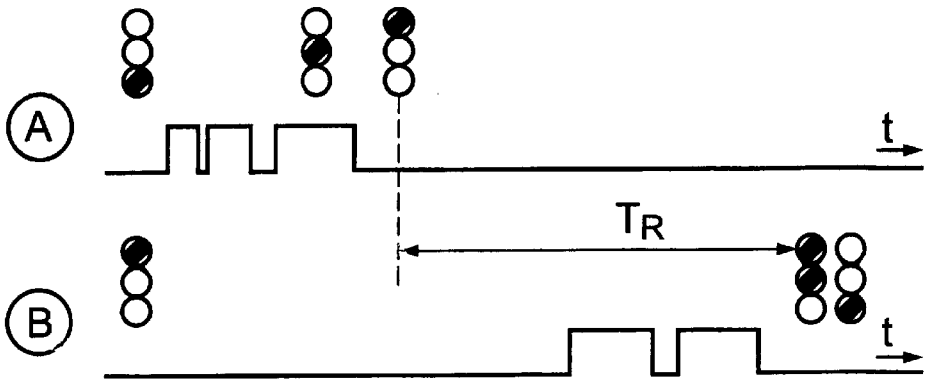
FIG. 6*a* shows time diagrams of a section of the process.

A simple example of the actual pulse patterns is shown in FIG. 6*a*. Preferably, for each vehicle detected, a pulse of a given duration is emitted and integrated. Frequently, however, the integration of the start times of the movement detector is sufficient without detecting the response to individual vehicles.

The timings of the associated sensor signals or (depending on the method of evaluation) a signal characteristic of the time taken for the column of vehicles to pass the entry point P, and in particular the time itself, are recorded in a memory 26 by means of the data transmitter 24 and also transmitted to the control unit 20. In order to obtain a time signal for entry into the restricted area which is independent of individual vehicles—which may cause erroneous measurements by prematurely turning within the restricted area or by travelling at a speed which is very different from the remainder of the column—there are two possible methods according to the invention: on the one hand the "key time" of the column may be formed by obtaining an average from the times at which the individual vehicles go past the entry and exit points. This can be done by computer by digitally averaging out the times of a timer initiated by the measuring pulse as the vehicle passes through, so that for further processing only the digital values of the average times for the column of vehicles to pass the entry and exit points, or the resulting transit time, need to be processed.

On the other hand, an analogue pulse form characteristic of the volume of vehicles travelling through is obtained by integration of the pulses of identical duration produced by each individual vehicle via the movement indicator, these pulses being fed into an integrating component (first order delay member). These pulses can also be further processed by switching on a re-triggerable monoflop, so that a number of pulses coincide and can add up to form individual pulses of considerable duration, as shown in FIG. 6*a*. As a result of the pulses entering in irregular sequence, an integrated pulse form is obtained, as shown hereinafter with reference to FIG. 6*b*. The value returns to zero as the number of vehicles reduces towards the end of the group. Thus, in addition to the average time taken to pass the sensor, characteristic information is obtained as to the distribution of the vehicles as they pass the entry to the restricted area, and this information can be used later for a form comparison.

Figure 6B:
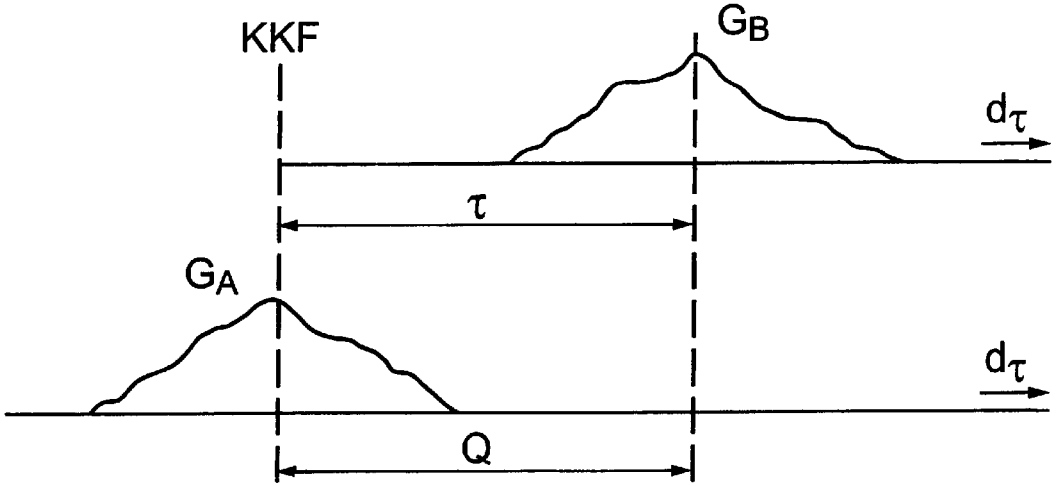
FIG. 6*b* shows diagrammatic evaluation patterns.

Once the vehicles have travelled along the measured distance M, they are detected once more by the exit sensors at point R. The measuring probes operate accordingly so that, depending on the method of measurement used, either a time measurement is obtained, representing the average time at which the column of vehicles passed the exit point, or an analogue pulse is obtained with a pattern as shown at the top of FIG. 6*b*. In the former case, the transit time can be determined simply by subtracting the time values recorded at the entry and exit points. However, if a form pulse is recorded the characteristic pattern of which is dependent on the density of succession of the vehicles, the transit time can additionally be qualified on the basis of the information contained in the pulse form, by a form comparison which is to be carried out, for example, by a correlating process (as described hereinafter). The characteristic signal patterns during entry and exit are made to coincide as far as possible, whilst the time shift required to do this forms the (average) transit time of the column of vehicles.

If the transit takes place for example in an enclosed main block of vehicles accompanied by individual vehicles out in front and a few stragglers, in the correlation process the characteristic form of the main block will determine the transit time, whilst the individual vehicles will be taken into account to a lesser extent. Accordingly, sensors with even greater information detection rates can be used for a correlating process. This can go beyond recognition of contours as far as video monitoring, in which the detection of the transit time can be carried out by correlating the video information recorded, so that the transit times of actually "recognised" vehicles are included in the averaging process.

Once the go time $T_F$ has expired (or if the go phase has been ended by one of the above mentioned methods for regulating the go phases), the next phase is not initiated until the clearance time $T_{RA}$ in progress has ended and none of the sensors at the exit end is detecting any vehicles still moving. This ensures that the lights cannot go green even when there are vehicles still within the restricted area E.

Figure 7:
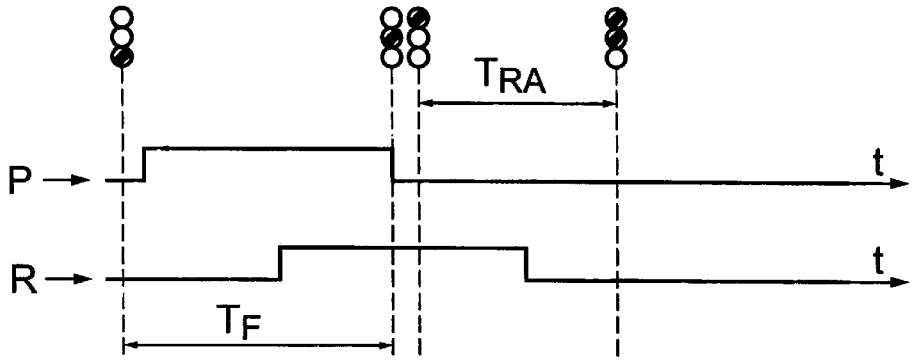
FIG. 7 shows other time diagrams including the evaluation pattern.
Figure 7:
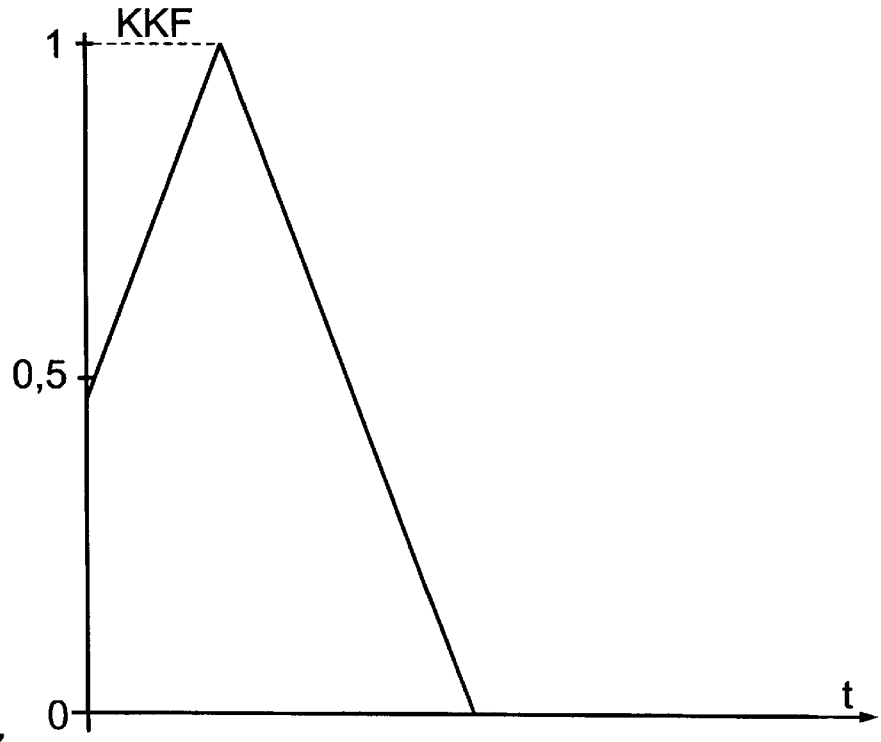

As soon as the next phase is initiated, the recording of the sensor signals starts afresh, and the sensor signal patterns determined up to that point from the preceding phase are passed on to the correlator or comparator 22. The sensor signal pattern of a light signal transmitter which showed green during the phase recorded is compared with all the sensor signal patterns of those light signal transmitters which did not show green. Since the vehicles which have entered the restricted area E generate a similar sensor signal pattern on leaving as they do on entering, but this pattern is shifted along the time axis t (FIGS. 6*a*, 7) by precisely the amount which the vehicles require to cross the restricted area E, the time shift at which the associated sensor signals show the maximum correspondence is equal to the clearance time $T_R$ actually required.

The clearance time $T_R$ thus determined is transmitted as an optimum value to the control unit 20 after a number of such values have been obtained. In the interests of rapid approximation to the optimum value, after each measurement the actual clearance time is corrected by a specified amount $\tau_{korr}$ towards the optimum which is desired. For safety reasons, corrections with an extending effect are usually adopted in full, whereas any shortening of the time is preferably distributed over a number of stages and is therefore carried out slightly more slowly.

Figure 5:
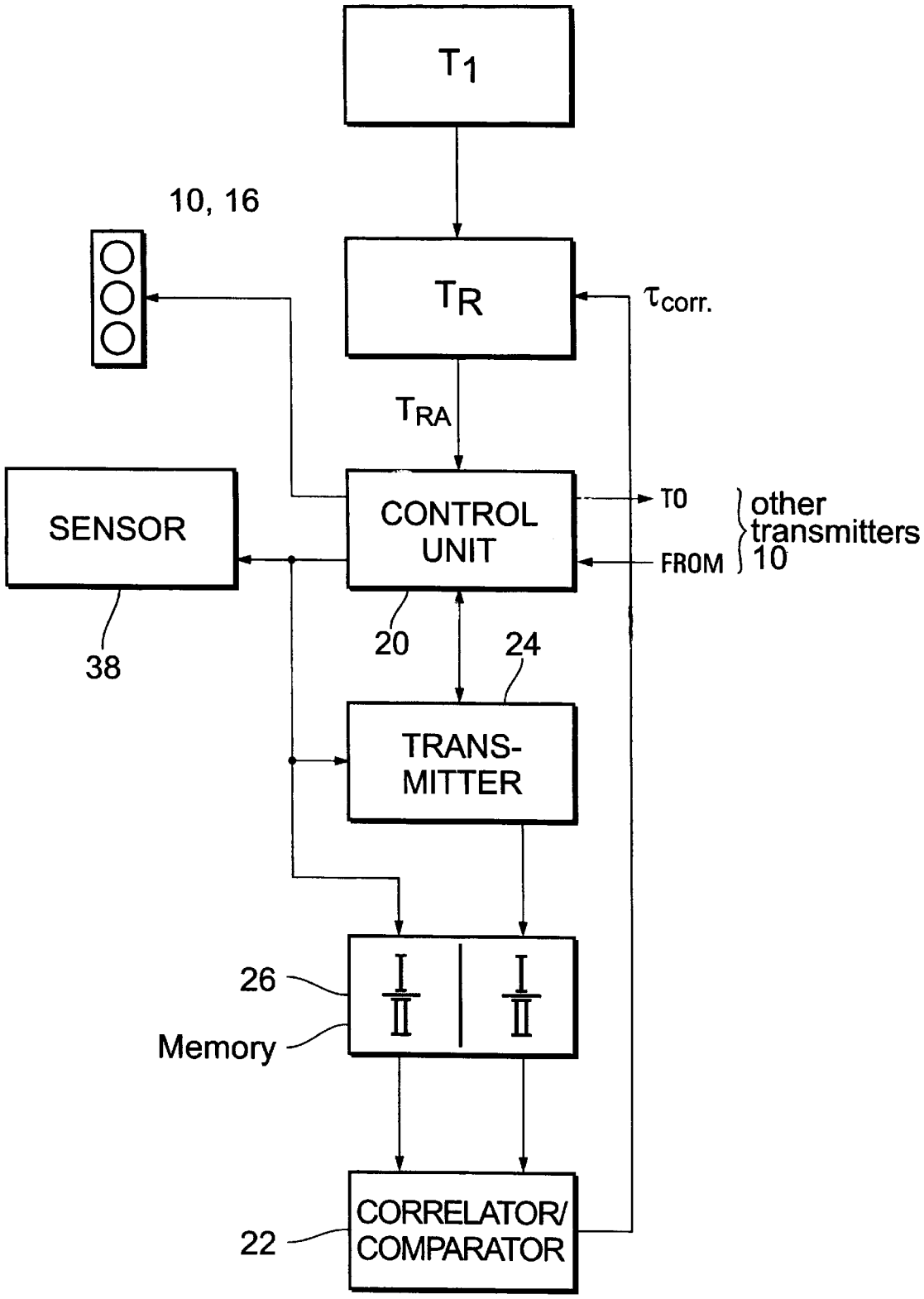
FIG. 5 is a block diagram to illustrate the course of the process.

The actual sensor signals of the movement indicator 38 associated with a light signal transmitter 10 in a station, e.g. A, are stored in a direct part of the memory 26 which is shown as the left hand side in FIG. 5. The sensor signals coming from all the other light signal transmitters 10 (stations B, . . . ) are recorded in a feedback part of the memory 26 (right hand side), in an input stage designated I. Adjoining this is at least one succeeding stage II which contains the last sensor signal patterns present and is next to receive the more recent values from stage I as soon as updating is carried out by the actual traffic phase.

The determination and correction of the clearance time $T_R$ by the method described takes place throughout the period of operation of the equipment. The clearance time measurements $T_R$ in the comparator 22 are determined continuously by means of a sufficiently large number of measurements, so that the clearance time is constantly adapted to varying traffic conditions. Parametric and non-parametric methods of mathematical statistics are suitable for comparing the sensor signal patterns; for example, the method of cross-correlation described hereinafter may be used. With the right kind of sensors, the comparison can also be carried out by means of the number of vehicles which have gone in and come out again. The process according to the invention can also be used with more than two traffic lights 10 if, for example, a junction is provided at the restricted area E.

The sensor signals generated by the sensors and intermediately stored in the memory enable each correlator or comparator 22 to form cross-correlation functions KKF from the sensor reaction of the actual transmitter 10 and from the sensor signal patterns coming from the or each other transmitter 10 (FIG. 5). When the patterns coincide, as already mentioned, the maxima G of these correlation functions KKF are displaced by precisely the time $T_D$ which the vehicles F take to travel through the measured distance M. FIG. 6*b* shows such a correspondence of the sensor signal patterns of a green phase recorded one after the other at stations A and B. However, if the maximum time shift which occurs is less than the clearance time $T_{RA}$ which has just been used, as is found during the associated adaptation stage, the clearance time $T_R$ is shortened by a set amount. Conversely, if the shift is greater or if the sensor now active at the exit point R in question, indicates that there are vehicles still moving after the clearance time $T_R$ has expired, the clearance time $T_R$ is extended by a given amount, until either this sensor is not indicating any more vehicles or until a maximum time is reached, e.g. twice the actual value.

Consequently, traffic coming from the opposite direction cannot be given a green signal until the restricted zone has been completely cleared. Moreover, in this way, too short a clearance time $T_R$ will be detected and immediately corrected. The optimisation can work both ways and, if necessary, may be carried out by different amounts until, before the start of the next green phase, general stopping of the traffic has been obtained, with no more vehicles moving.

The sensor signals of the movement indicators 38 either show one (sensor triggered) or zero (sensor not triggered). For the aperiodic sensor signals $V_1(t)$ and $V_2(t)$ the following is obtained as cross-correlation function:

$$KKF(\tau) = \int_o^\infty V_i(t) \cdot V_2(t+\tau)\,d\tau;$$

with the same sensor signals it yields the maximum value:

$$KKF_{\max} = \int_o^\infty V_i^2(t)\,dt;$$

with different sensor signals the smaller value of the integral over each individual pattern is used for control and the KKF is standardized for evaluation at this value.

For the clearance time $T_R$, the time shift Tmax is used at which the standardized $KKF_n$ assumes its maximum G. In the event of several equal maxima G, the largest of the associated τ-values is chosen. The measurement is discarded as unusable if the standardized $KKF_n$ does not reach a level of at least 0.75; the last clearance time $T_R$ will then remain.

If $\tau_{max}$ exceeds the actual clearance time $T_{RA}$, this is increased directly, for safety reasons, by the amount of the difference, or otherwise lowered by smaller amounts in two or more stages. The amount of the correction may be greater, the closer the maximum G of the standardized $KKF_n$ is to 1. A favorable process consists in taking, as the correction value, not more than half the difference between $T_{RA}$ and $T_{max}$ in accordance with $$\tau_{korr}=(\tau_{max}-T_{RA})/2\cdot KKF(\tau_{max})\cdot$$

After only five measuring periods the clearance time $T_R$ can thus be adapted to about 5% of the initial deviation, as shown by the following example.

| Measuring Period | $T_{korr}$ (s) | $T_{RA}$ (s) |
|---|---|---|
| 1 | 5.0 | 25.0 |
| 2 | 2.5 | 22.5 |
| 3 | 1.5 | 21.3 |
| 4 | 0.6 | 20.7 |
| 5 | 0.3 | 20.4 |

In practice, the clearance times $T_R$ are rounded up to complete seconds. If no clear maximum can be found in one of the correlating functions KKF, no correction is made. Since the joining of a number of traffic streams within the restricted area E must be prevented, no correlating function can have several maxima G if the sensors are operating correctly. By the correlation and the stepwise adjustment of the clearance time $T_R$, faulty reactions of the sensors or movement indicators 38 are largely picked up and compensated for. Such errors may occur, for example, because of defective adjustment, inadequacies of the method of measurement or the detector principle or by individual exceptional times caused by reckless drivers or crawlers. The stepwise adjustment of the clearance times $T_R$ also means that the correlation function KKF does not have to be carried out on line and need not be done for every traffic phase or traffic light phase. However, the more valid correlations there are, the better adapted the clearance time $T_R$ will be to the traffic conditions prevailing.

Figure 9:
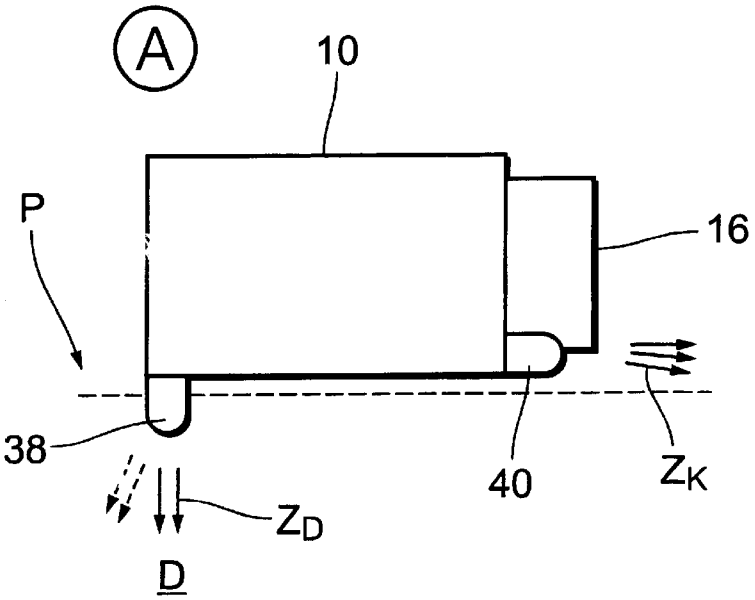
FIG. 9 is a diagrammatic plan view of a movement indicating arrangement at one end of a restricted area.
Figure 8:
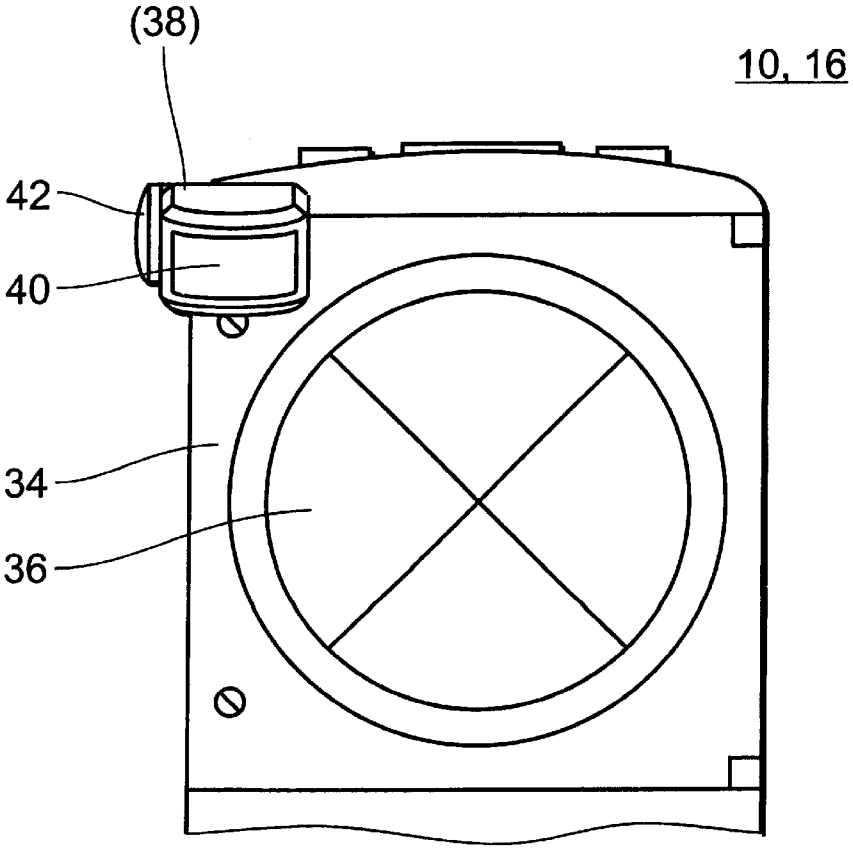
FIG. 8 is a partial front elevation of a traffic light with movement indicator.

It should be noted that the sensors are used in addition to any detectors already present for regulating the green phase, but may if desired also be used to carry out the time gap method. The sensors or movement indicators 38 may be provided on or in the ground, close to the ground or some height above the carriageway. In the Examples in FIGS. 3, 8 and 9, a movement indicator 38 acting at right angles to the carriageway in the direction $Z_D$, detecting the vehicles passing through, is mounted on the upper part of a traffic light 10 above the light unit 16. In addition, a front movement indicator 40 may be provided, the direction of scanning $Z_K$ of which (FIG. 9) detects the oncoming vehicles and is mounted, for example, on the door 34 of the light unit 16, suitably screened, above a lamp area 36 on an angle arm 42. This arrangement makes it possible to use the light signal equipment in demand operation and to make any adjustments required continuously by the time gap method. It is also possible, and provided according to the invention, to accommodate two such detectors or movement indicators 38, 40 so as to be rotatable relative to one another in a construction unit.

It is crucial to the process according to the invention that the traffic travelling over the measured distance M should be reliably detected by sensors operating at right angles to the carriageway, at all the entry and exit points of the restricted area E. Disruptive influences of every kind are eliminated as far as possible, particularly as all the measuring and regulating values at all the stations of the light signal equipment are measured, stored and evaluated, thus ensuring a constant reciprocal control. In addition, this makes it possible to judge whether the sensor signals delivered are actually detecting the traffic. In any case, the clearance time TD is automatically optimally adjusted to the particular conditions prevailing. In conjunction or parallel with the known possibilities for regulating the transit times TD, as described above, this reduces the operation required in most cases to simply switching on the equipment.

Depending on the type of construction of the equipment, the clearance times can be determined from the signals obtained for both directions of travel, but also may be obtained separately for both directions of travel (by duplicating the circuitry components shown).

Only in particularly extreme situations (e.g. in the event of a very long restricted area E) is it necessary to input special preset values $T_i$ for the clearance times. Apart from increased safety, the learning capacity of the equipment, which can adapt to given daily or weekly rhythms, achieves maximum traffic throughput, which is of great importance economically. An increase in traffic throughput at building sites in the Federal Republic of Germany alone by an amount of 10 to 20% per day can save millions by correspondingly reducing the fuel required and the waiting times involved and will additionally have a major ecological benefit.

All the features and advantages apparent from the claims, specification and drawings, including any details of construction, process steps and three dimensional arrangements, may be essential to the invention both per se and in all kinds of combinations.

The invention is therefore not restricted to the preferred embodiment described hereinbefore. Rather, a number of variants are possible, which make use of the solution illustrated but with fundamentally different embodiments.

What is claimed is:

1. A method for regulating traffic with movable light signalling equipment including mobile traffic lights, in traffic restriction areas using sensor controls which prescribe go times defined as green phases and clearance times defined as red phases in the traffic restriction area to be secured, a traffic restriction area being an area along a blocked stretch of roadway in which traffic is restricted by the light signalling equipment, the method comprising:

sensing traffic and measuring the transit times of vehicles over a measured distance extending substantially along the traffic restriction area to be secured with the sensor controls;

determining the clearance time as a function of the transit time measurements obtained; and controlling the light signalling equipment to regulate traffic in the traffic restriction area to be secured based on the determined clearance time.

2. A method according to claim 1, wherein the traffic restriction area to be secured includes an entry and an exit point, wherein transit time is measured by determining at least one quantity selected from the group consisting of:

a difference in average times for at least a selected number of vehicles to pass by a respective entry and exit point of the traffic restriction area; and a time difference in the appearance of a signal characteristic of vehicles passing the entry or exit point, wherein the signal changes in time and wherein the signal characteristic is dependent on a time distribution of the vehicles as they pass by the respective entry and exit points.

3. A method according to claim 1, wherein the traffic restriction area to be secured includes an entry and an exit point, and wherein the transit time is measured based on an output signal of a sensor which is activated as a vehicle passes by an entry or exit point to produce a starting signal, the starting signal being fed to timing means including an integrating component.

4. A method according to claim 1 further comprising adjusting clearance time based on the transit time measurements obtained, by repeatedly changing the clearance time in steps of fixed or variable length, starting from a preselected maximum clearance time set when the light signalling equipment is switched on.

5. A method according to claim 1 wherein transit time and clearance time are established separately according to the directions of travel of traffic through the traffic restriction area to be secured.

6. A method according to claim 4, wherein amounts of adjustment of the clearance time are greater for lengthening the clearance time than for shortening the clearance time, and wherein the amounts of adjustment are adopted in full when extending the clearance time but are spread over a number of adjustment steps when shortening the clearance time.

7. A method according to claim 1, wherein measurement of the transit times is carried out by vehicle detection at an angle to the direction of the measured distance at both ends thereof in the region of entry and exit points to the traffic restriction area to be secured.

8. A method according to claim 4, further comprising:

comparing respective actual clearance times and measured transit times of each respective light signalling equipment using at least one statistical method; and performing correlation on the respective actual clearance times and measured transmit times of each respective light signalling equipment to derive correction parameters and produce adjustment amounts for adjusting the clearance time.

9. A method according to claim 1, wherein the light signalling equipment includes respective traffic sensors for sensing traffic and producing traffic sensing signals, wherein the method further comprises:

generating a cross-correlation from the traffic sensing signals generated by individual traffic sensors of the light signalling equipment, obtaining a time gap between successive maxima of the cross-correlation, forming a transit time adjustment value from the time gap, determining a clearance time shift magnitude, and deriving the clearance time from the clearance time shift.

10. A method according to claim 9, further comprising:

shortening a last clearance time at any one time by a preset amount if the last clearance time exceeds a largest time gap between maxima determined, and extending the last clearance time by a preset amount if the last clearance time is less than the largest time gap between maxima determined.

11. A method according to claim 1, further comprising increasing the clearance time if movement of a vehicle is detected along the measured distance in a safety interval added to the clearance time determined, before the next go time.

12. Apparatus for regulating traffic in traffic restriction areas to be secured, a traffic restriction area being an area along a blocked stretch of roadway in which traffic is restricted by traffic lights, comprising:

moveable light signal stations including mobile traffic lights using sensor controls which prescribe go times defined as green phases and clearance times defined as red phases which are adjustable in the traffic restriction area to be secured; and means for measuring transit time of vehicles along a measured distance extending substantially along the traffic restriction area to be secured;

wherein electrical signals derived from the transit time measurements are output from the means for measuring the transit time and fed into the sensor controls.

13. An apparatus according to claim 12, further comprising sensors for detecting vehicles, the sensors being aimed at an angle to the measured distance and mounted at both ends of said measured distance.

14. An apparatus according to claim 12, further comprising, at least at one end of the measured distance, a pair of sensors which are effective with respect to each other at an angle of at least 90 degrees.

15. An apparatus according to claim 12, further comprising two sensors which are rotatable relative to each other and are provided in a common construction unit.

16. An apparatus according to claim 12, wherein at least two of said light signal stations and information transmitters are provided with respective sensors, and wherein said sensors are linked by said information transmitters.

17. An apparatus according to claim 16, wherein said information transmitters comprise at least one of radio or cable.

* * * * *